US006338299B1

(12) United States Patent
Kamoda et al.

(10) Patent No.: US 6,338,299 B1
(45) Date of Patent: Jan. 15, 2002

(54) SHEET-LIKE MATERIAL PRINTING AND COATING SYSTEM AND METHOD

(75) Inventors: Hiroyoshi Kamoda; Mitsuhiro Uehara, both of Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/364,030

(22) Filed: Jul. 30, 1999

(30) Foreign Application Priority Data

Jul. 30, 1998 (JP) ..... 10-215110
Jul. 9, 1999 (JP) ..... 11-195220

(51) Int. Cl.[7] ..... B41F 5/02; B41F 23/04

(52) U.S. Cl. ..... 101/424.1; 101/231; 101/488; 118/46; 118/224; 427/211

(58) Field of Search ..... 101/416.1, 424.1, 101/424.2, 221, 220, 229, 230, 231, 488, 183; 118/46, 66, 209, 216, 223, 224, 225, 226, 227, 211, 212; 427/211

(56) References Cited

U.S. PATENT DOCUMENTS 4,794,856 A * 1/1989 Giori ..... 101/152
4,939,992 A * 7/1990 Bird ..... 101/424.1
5,479,856 A * 1/1996 Wirz ..... 101/229
5,651,316 A * 7/1997 DeMoore et al. ..... 101/424.1
5,727,472 A * 3/1998 Burgio ..... 101/424.1
5,832,833 A * 11/1998 Burgio ..... 101/424.1
5,873,309 A * 2/1999 Mack et al. ..... 101/424.1
6,143,074 A * 11/2000 Komori ..... 118/209

FOREIGN PATENT DOCUMENTS

DE 4213024 A1 10/1993
EP 0085751 A1 8/1983
GB 2279299 A 1/1995

OTHER PUBLICATIONS

Patent Abstracts Of Japan, vol. 15, No. 146, Apr. 12, 1991—abstract for JP 03–024958 A, published Feb. 1, 1991.
"Vu et enteedu a la Drupa," Nouvelles Graphiques, vol. 40, No. 13, Jun. 1990 (1990–06), p. 32 XP000015116, Anvers.

* cited by examiner

*Primary Examiner*—Leslie J. Grohusky

(57) ABSTRACT

Four impression cylinders of first and second face-side coating units and first and second back-side coating units, and two transfer cylinders of a face-side drying unit and a back-side drying unit are arranged adjacently and nearly linearly in a paper flow direction. Above circumferential surfaces of the odd-numbered cylinders of these cylinders, the first face-side coating unit, the second face-side coating unit, and the face-side drying unit are arranged. Below circumferential surfaces of the even-numbered cylinders, the first back-side coating unit, the second back-side coating unit, and the back-side drying unit are arranged. Above the circumferential surfaces of the odd-numbered cylinders, a first face-side drying device and a second face-side drying device, each of which has one dryer, are disposed downstream of the first face-side coating unit and the second face-side coating unit, respectively. Below the circumferential surfaces of the even-numbered cylinders, a first back-side drying device and a second back-side drying device, each of which has one dryer, are disposed downstream of the first back-side coating unit and the second back-side coating unit, respectively.

10 Claims, 6 Drawing Sheets

SHEET-LIKE MATERIAL PRINTING AND COATING SYSTEM AND METHOD

BACKGROUND OF THE INVENTION

1. Field of the Invention

The present invention relates to a sheet-like material coating system in a sheet-fed offset printing press.

2. Description of the Related Art

A polymer-based banknote circulating abroad, called "a plastic banknote", requires the addition of a treating step after printing, as compared with printing of a banknote based on ordinary paper. That is, coating is performed for the following purposes:

(1) Protection for making printed surfaces wear minimally (Sealer).

(2) Decreasing gloss, and providing a paper-like texture (Matt).

Furthermore, printing intended to prevent forgery, such as printing with ultraviolet luminescent ink (Black Light), is often carried out during this treating step. For these reasons, a machine specifically designed for coating is additionally provided in a process for production of "a plastic banknote". The coating treatment is performed in the following order: (1) If desired, offset printing aimed for prevention of forgery, (2) application of a sealer, and (3) matting.

Generally, a banknote is printed on both sides, and thus requires double-sided coating. Conventional examples of a machine constituted for this purpose are shown in FIGS. 5 and 6. FIG. 5 shows a system composed of two machines arranged for performing printing and coating of a face side and a back side of a sheet separately, in two passes, each machine comprising a feeding unit 100, a first offset printing unit 101, a second offset printing unit 102, a first coating unit 103, a second coating unit 104, and a delivery unit 105 provided in this order along flow of the sheet. FIG. 6 shows a system for performing only coating of a face side and a back side of a sheet in one pass by use of an inverting cylinder 108, the system comprising a feeding unit 100, a first coating unit 103, a second coating unit 104, a first offset printing unit 101, a second offset printing unit 102, a third coating unit 106, a fourth coating unit 107, and a delivery unit 105 provided in this order along flow of the sheet, the inverting cylinder 108 being interposed between the second coating unit 104 and the first offset printing unit 101.

However, the former system posed the problems of requiring a floor space for installation of the two machines, and necessitating operations for transporting and inverting the sheet between the machines. The latter system occupied a smaller space than the former system, but involved the problem of having a larger entire length per machine, and carrying the risk of causing scratches or rubs during inversion of the sheet.

SUMMARY OF THE INVENTION

The present invention has been accomplished in view of the above-described problems. It is an object of the invention to provide a sheet-like material coating system which can perform coating of a face side and a back side of a sheet in one pass with a reduced space and without requiring inversion of the sheet.

To attain the above object, the present invention claims a sheet-like material coating system for receiving and transferring a sheet-like material, and coating the sheet-like material, including:

an upstream cylinder and a downstream cylinder arranged adjacently in a direction of transport of the sheet-like material;

a first coating unit for coating a face side or a back side of the sheet-like material on the upstream cylinder;

a first drying device for drying the face side or back side of the sheet-like material on the upstream cylinder after coating by the first coating unit;

a second coating unit for coating the back side or face side of the sheet-like material on the downstream cylinder; and a second drying device for drying the back side or face side of the sheet-like material after coating by the second coating unit.

According to the foregoing constitution, the coated surface is dried by the first drying device immediately after coating, so that an impression cylinder is prevented from being stained upon intimate contact with the coated surface during coating of the reverse surface. Consequently, double-sided coating is completed in one pass, thereby achieving a saving in space. Moreover, the sheet-like material is not inverted, and thus no scratches or rubs occur.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

PREFERRED EMBODIMENTS OF THE INVENTION

A sheet-like material coating system according to the present invention will now be described in detail by way of the following Embodiments with reference to the accompanying drawings, but it should be understood that the invention is not restricted thereby.

First Embodiment

Figure 1:
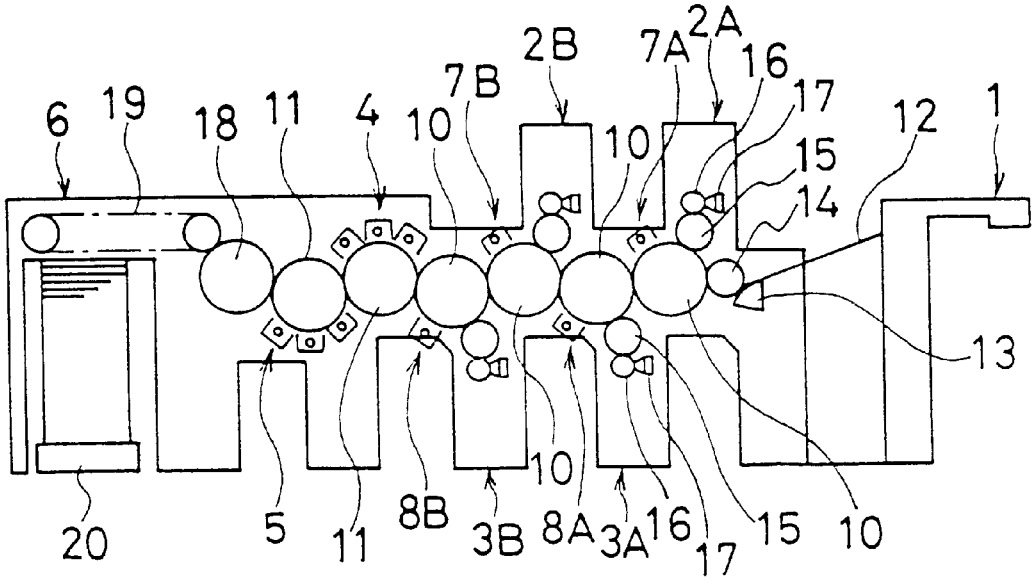
FIG. 1 is a side view of a sheet-fed offset printing press showing a first embodiment of the present invention.

FIG. 1 is a side view of a sheet-fed offset printing press showing a first embodiment of the present invention.

In FIG. 1, the reference numeral 1 denotes a feeding unit, 2A, 2B denote a first and a second face-side coating unit, respectively, for coating a face side of paper (a sheet-like material), 3A, 3B denote a first and a second back-side coating unit, respectively, for coating a back side of the paper, 4 denotes a face-side drying unit for drying the face side of the paper, 5 denotes a back-side drying unit for drying the back side of the paper, and 6 denotes a delivery unit.

In the illustrated embodiment, four impression cylinders 10 of the coating units 2A, 2B, 3A, 3B, and two transfer cylinders 11 of the drying units 4, 5 are arranged adjacently and nearly linearly in a paper flow direction. Above circumferential surfaces of the odd-numbered cylinders (counted from the upstream side in the paper flow direction) of these cylinders, the first face-side coating unit 2A, the second face-side coating unit 2B, and the face-side drying unit 4 are arranged. Below circumferential surfaces of the even-numbered cylinders, the first back-side coating unit 3A, the second back-side coating unit 3B, and the back-side drying unit 5 are arranged. Above the circumferential surfaces of the odd-numbered cylinders, a first face-side drying device 7A and a second face-side drying device 7B, each of which has one dryer, are disposed downstream of the first face-side coating unit 2A and the second face-side coating unit 2B, respectively. Below the circumferential surfaces of the even-numbered cylinders, a first back-side drying device 8A and a second back-side drying device 8B, each of which has one dryer, are disposed downstream of the first back-side coating unit 3A and the second back-side coating unit 3B, respectively.

The feeding unit 1 sucks sheets of paper, which are placed on a sheet piling board (not shown), one by one by a suction device, and feeds the sheet onto a feedboard 12. The sheet is then fed by a swing arm shaft pregripper 13 to the first face-side coating unit 2A via a feeding cylinder 14.

The coating units 2A, 2B, 3A, 3B are ordinary ones each including the aforementioned impression cylinder 10 for receiving paper and holding it, a blanket cylinder 15 adjoining the impression cylinder 10 and having a resin plate (not shown) mounted on a circumferential surface thereof, an anilox roller 16 for supplying varnish to a plate surface of the resin plate on the blanket cylinder 15, and a chamber coater 17.

It is to be noted that the drying units 4, 5 each comprise an aforementioned transfer cylinder 11 and one or more, preferably three, drying devices disposed along a circumferential surface of the respective transfer cylinder as shown, for example, in FIG. 1.

The delivery unit 6 receives the sheet from the back-side drying unit 5 by a delivery chain 19 via a delivery cylinder 18, transports the thus received sheets, and causes them to fall onto a sheet piling board 20 for piling.

Because of the foregoing constitution, a sheet fed from the feeding unit 1 via the feeding cylinder 14 has its face side coated with varnish on the impression cylinder 10 of the first face-side coating unit 2A, whereby the first coating is performed. Then, the coated sheet is heated and dried by the first face-side drying device 7A. Then, the sheet has its back side coated with varnish on the impression cylinder 10 of the first back-side coating unit 3A, whereby the first coating is performed. Then, the coated sheet is heated and dried by the first back-side drying device 8A. Thereafter, the sheet has its face side coated with varnish on the impression cylinder 10 of the second face-side coating unit 2B, whereby the second coating is performed. Then, the coated sheet is heated and dried by the second face-side drying device 7B. Subsequently, the sheet has its back side coated with varnish on the impression cylinder 10 of the second back-side coating unit 3B, whereby the second coating is performed. Then, the coated sheet is heated and dried by the second back-side drying device 8B. Thereafter, the sheet has its face side heated and dried on the transfer cylinder 11 of the face-side drying unit 4, and then has its back side heated and dried on the transfer cylinder 11 of the back-side drying unit 5. Finally, the sheet is sent to the delivery unit 6 via the delivery cylinder 18, whereby coating of the face and back sides of the sheet is completed.

Figure 6:
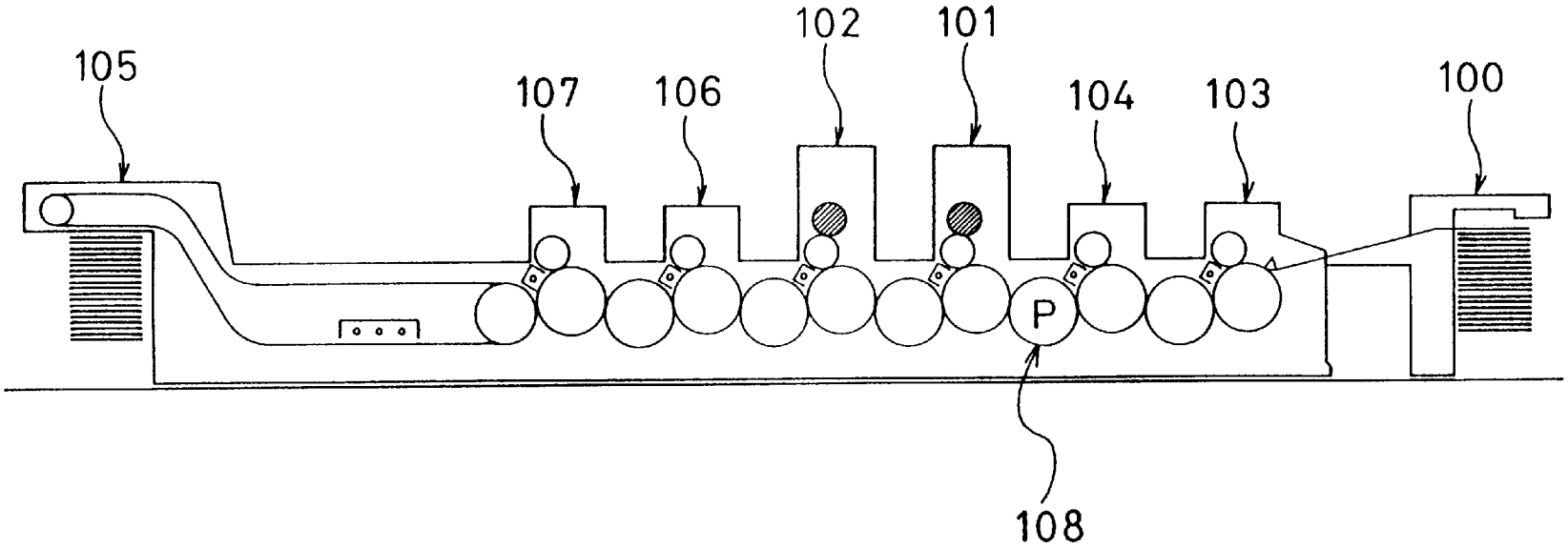
Fig. 6 Related Art
FIG. 6 is a side view of a sheet-fed offset printing press as a different conventional example.

According to the present embodiment, coating of the face and back sides of a sheet is performed in one pass without using an inverting cylinder (see the inverting cylinder 108 in FIG. 6). Thus, a saving in space can be achieved, and no scratches or rubs due to inversion occur.

By the way, since the face side and back side of a sheet are alternately coated in one pass, the coated surfaces intimately contact the impression cylinder 10 (and the transfer cylinder 11). According to the present embodiment, however, the coated surfaces are heated and dried by the drying devices 7A, 7B, 8A, 8B immediately after coating. Thus, the circumferential surface of the impression cylinder 10 (and the circumferential surface of the transfer cylinder 11) is not stained, and a failure in printing is prevented.

Second Embodiment

Figure 2:
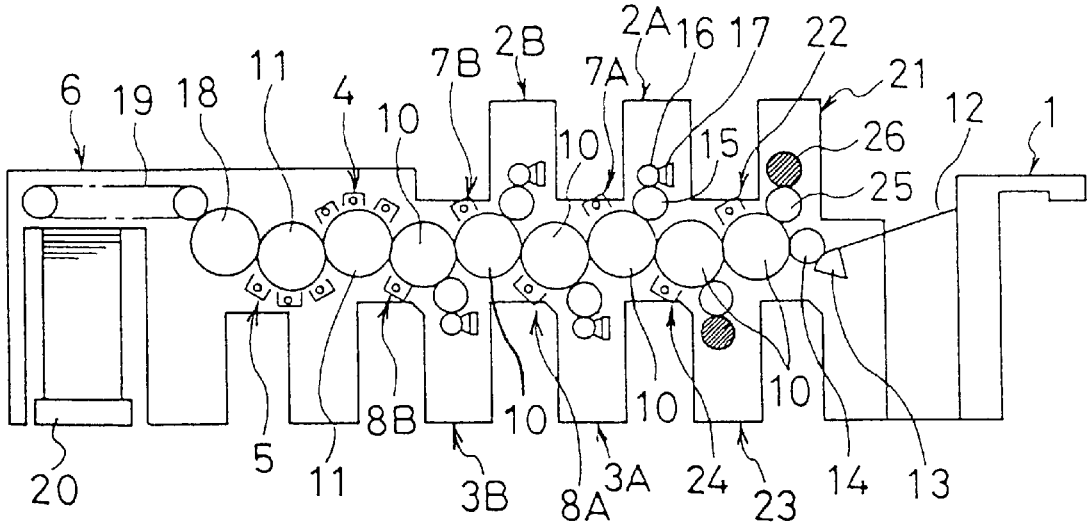
FIG. 2 is a side view of a sheet-fed offset printing press showing a second embodiment of the present invention.

FIG. 2 is a side view of a sheet-fed offset printing press showing a second embodiment of the present invention. This is an embodiment in which two impression cylinders 10 are added forward of the impression cylinder 10 of the first face-side coating unit 2A in the First Embodiment; above a circumferential surface of the impression cylinder 10 located on the foremost row, a face-side offset printing unit 21 is disposed together with a face-side drying device 22; and below a circumferential surface of the impression cylinder 10 located on the second row, a back-side offset printing unit 23 is disposed together with a back-side drying device 24. The offset printing units 21, 23 are ordinary ones each including the aforementioned impression cylinder 10 for receiving paper and holding it, a blanket cylinder 25 adjoining the impression cylinder 10, and a plate cylinder 26 adjoining the blanket cylinder 25. The drying devices 22, 24 each comprise one dryer.

In accordance with this embodiment, offset printing and coating on the face and back sides of paper can be performed in one pass without the use of an inverting cylinder (see the inverting cylinder 108 in FIG. 6). Thus, a saving in space and improvement of quality can be realized. Besides, the printed surface and the coated surface are dried immediately after printing and coating. Thus, the circumferential surfaces of the impression cylinder 10 and the transfer cylinder 11 are not stained, and a failure in printing is prevented.

Third Embodiment

Figure 3:
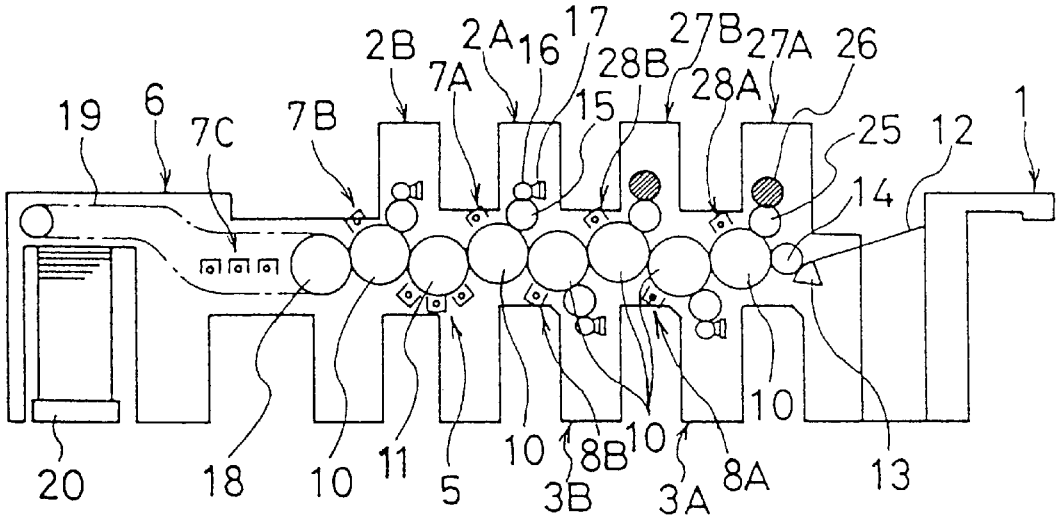
FIG. 3 is a side view of a sheet-fed offset printing press showing a third embodiment of the present invention.

FIG. 3 is a side view of a sheet-fed offset printing press showing a third embodiment of the present invention. This is an embodiment in which first and second face-side offset printing units 27A and 27B, and first and second face-side drying devices 28A and 28B having the same constitutions as the face-side offset printing unit 21 and the face-side drying device 22, respectively, in the Second Embodiment are disposed at the positions of the first and second face-side coating units 2A and 2B and the first and second face-side drying devices 7A and 7B in the First Embodiment; rearward of (downstream of in a paper flow direction) the printing units 27A, 27B and the drying devices 28A, 28B, the first and second face-side coating units 2A and 2B and the first and second face-side drying devices 7A and 7B in the First Embodiment are disposed, with impression cylinders 10 being added on both sides of the transfer cylinder 11 having the back-side drying unit 5 in the First Embodiment. Furthermore, the transfer cylinder 11 included in the face-side drying unit 4 in the First Embodiment has been abolished, and instead, three face-side drying devices 7C have now been disposed inside a delivery chain 19 of a delivery unit 6 that has been extended.

In accordance with this Embodiment, not only offset printing and coating on the face side of paper, but also coating on the back side of the paper can be performed in one pass without the use of an inverting cylinder (see the inverting cylinder 108 in FIG. 6). Thus, a saving in space and improvement of quality can be realized.

Fourth Embodiment

Figure 4:
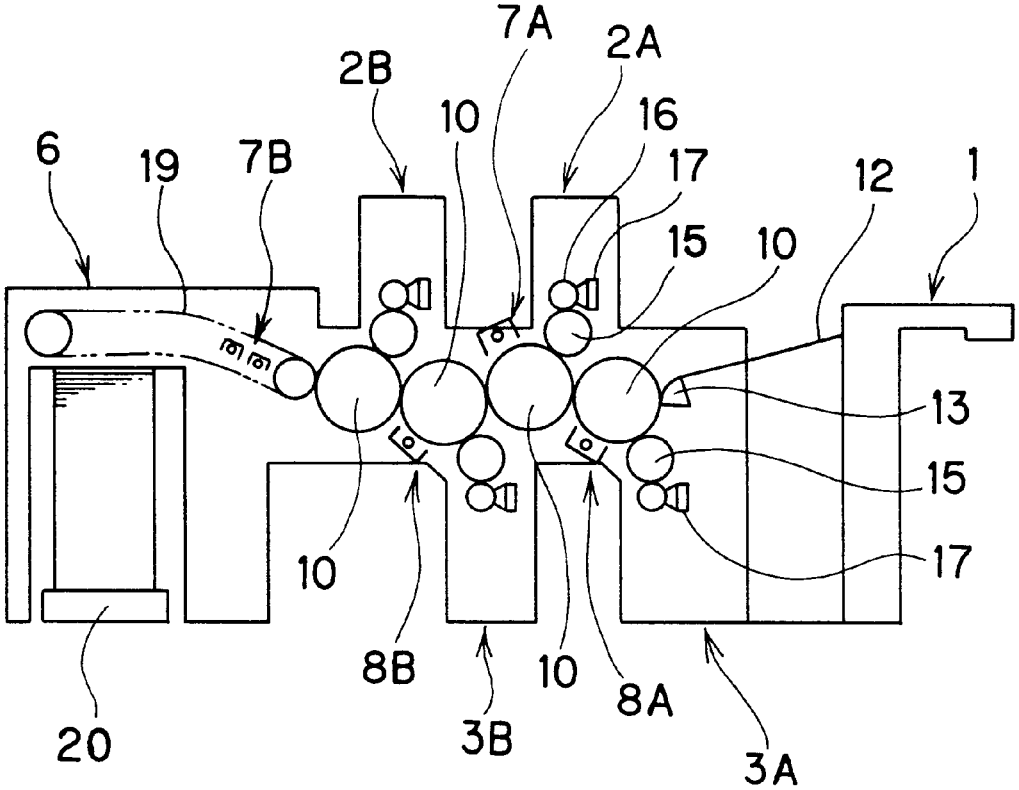
FIG. 4 is a side view of a sheet-fed offset printing press showing a fourth embodiment of the present invention.
Figure 5:
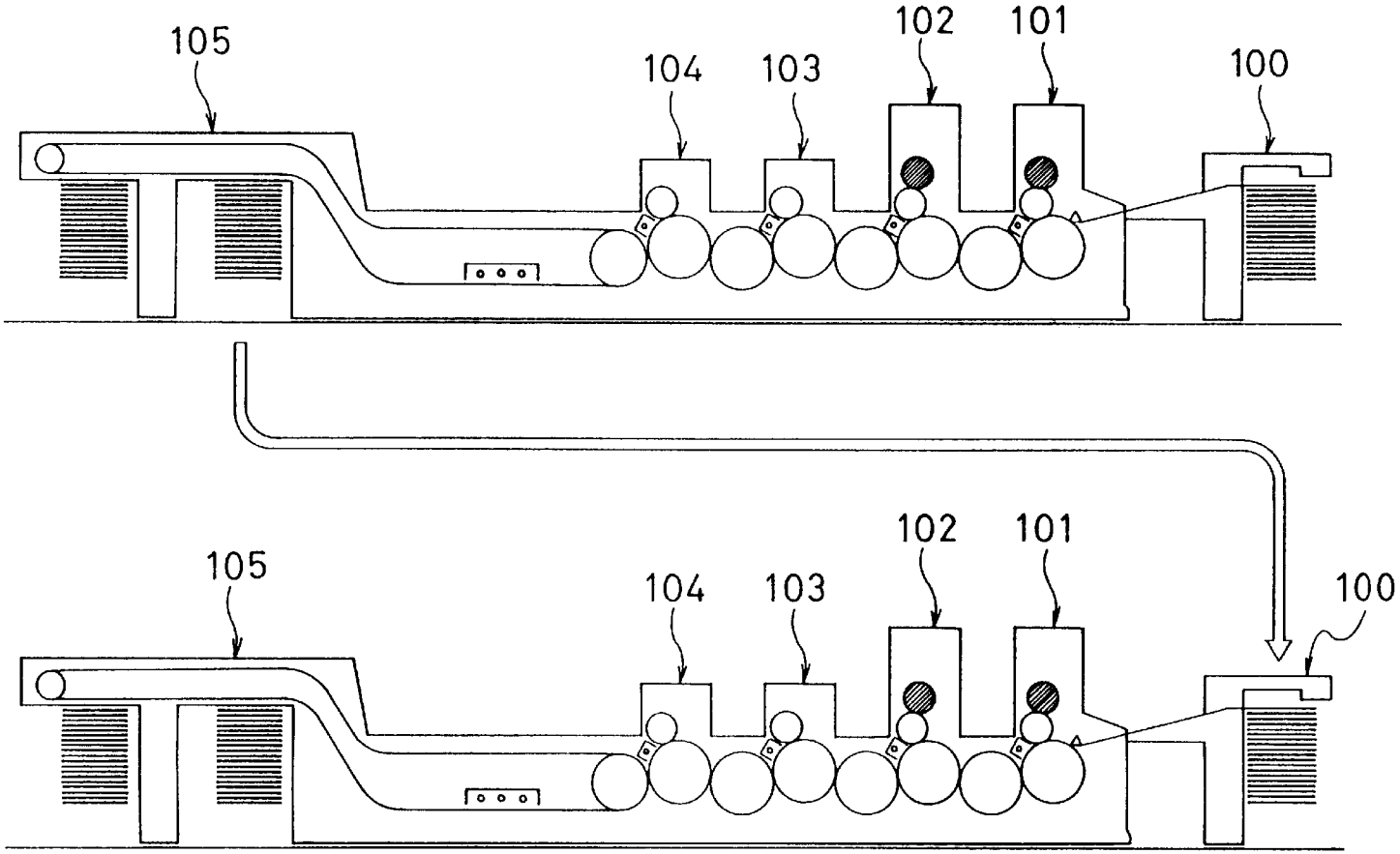
Fig.5 Related Art
FIG. 5 is a side view of a sheet-fed offset printing press as a conventional example.

FIG. 4 is a side view of a sheet-fed offset printing press showing a fourth embodiment of the present invention. This is an embodiment in which the first and second back-side coating units 3A and 3B in the First Embodiment are placed preceding the first and second face-side coating units 2A and 2B, and the sheet surface coated by the second face-side coating unit 2B is heated and dried by the second face-side drying device 7B disposed in the delivery chain 19 area. The same actions and effects as in the First Embodiment are obtained.

This invention being thus described, it will be obvious that the same may be varied in many ways, such that there may be a plurality of the sheet piling boards of the delivery unit. Such variations are not to be regarded as a departure from the spirit and scope of the invention, and all such modifications as would be obvious to one skilled in the art are intended to be included within the scope of the following claims.

What is claimed is:

1. A single pass, perfecting sheet-like material coating apparatus, comprising:

a first coating unit including a first coating impression cylinder;

a second coating unit including a second coating impression cylinder;

a third coating unit including a third coating impression cylinder; and a fourth coating unit including a fourth coating impression cylinder;

the first and second coating impression cylinders being in contact with one another, the second and third coating impression cylinders being in contact with one another, the third and fourth coating impression cylinders being in contact with one another, said first and third coating units are adapted to apply a first and a third coating to a first surface of the sheet-like material and said second and fourth coating units are adapted to apply a second and a fourth coating to a second surface of the sheet-like material such that said coating units apply respective coatings to alternate first and second surfaces of the sheet-like material, each of said coating units including a drying device therein, wherein each of said drying devices dries a respective coating applied to the sheet-like material at least to an extent that a subsequent one of said coating impression cylinders is not substantially stained by the respective coating, wherein the first, second, third and fourth coating units are adapted to coat the sheet-like material with two coatings on each of the first and second surfaces thereof in a single pass through the apparatus; and at least one drying unit including a transfer cylinder and one or more drying devices opposed to the transfer cylinder for drying the sheet-like material transported by the transfer cylinder, the transfer cylinder of the drying unit being provided for transporting the sheet-like material from the fourth coating impression cylinder of the fourth coating unit.

2. The apparatus according to claim 1, wherein said at least one drying unit comprises:

a first and second drying unit each including the transfer cylinder and one or more drying devices disposed adjacent a respective transfer cylinder of said first and second drying units for drying the first and second surfaces of the sheet-like material, the transfer cylinder of the first drying unit being provided for transporting the sheet from the fourth coating impression cylinder of the fourth coating unit and the transfer cylinder of the second drying unit being provided for transporting the sheet-like material from the transfer cylinder of the first drying unit.

3. The apparatus according to claim 1, further comprising:

a first and second printing unit located upstream of said coating units, each of which includes a printing impression cylinder and a drying device.

4. The apparatus according to claim 3, wherein the printing impression cylinder of said second printing unit is in contact with the first coating impression cylinder of said first coating unit.

5. A method of coating sheet-like material, comprising:

adjacently arranging a first upstream cylinder and a first downstream cylinder in a transport direction of the sheet-like material such that the first upstream cylinder contacts the first downstream cylinder;

coating a face side or a back side of the sheet-like material on the first upstream cylinder;

drying the face side or back side of the sheet-like material on the first upstream cylinder after said first coating step such that the first downstream cylinder is not substantially stained by the first coating;

coating an opposite side of the back side or face side of the sheet-like material on the first downstream cylinder;

drying an opposite side of the back side or face side of the sheet-like material after said second coating step;

adjacently arranging a second upstream cylinder and a second downstream cylinder in the transport direction of the sheet-like material such that the second upstream cylinder contacts the second downstream cylinder;

adjacently arranging the first downstream cylinder and the second upstream cylinder in the transport direction of the sheet-like material such that the first downstream cylinder contacts the second upstream cylinder;

applying a third coating with the second upstream cylinder to the face side or back side of the sheet-like material to which the first coating was applied;

applying a fourth coating with the second downstream cylinder to the opposite of the face side or back side of the sheet, drying each of the respective coatings applied to the sheet-like material at least to an extent that a subsequent one of the upstream or downstream cylinders is not substantially stained by the respective coating, wherein the first and second upstream and downstream cylinders coat the sheet-like material with two coatings on each of the face side and back side thereof in a single pass; and, providing a drying unit including a transport cylinder and one or more drying devices opposed to the transport cylinder for drying the sheet-like material transported by the transport cylinder, the transport cylinder of the drying unit being provided for transporting the sheet-like material from the second downstream cylinder.

6. A single pass, perfecting sheet-like material printing and coating apparatus, comprising:

a first printing unit including a first printing impression cylinder;

a first coating unit including a first coating impression cylinder;

a second printing unit including a second printing impression cylinder;

a second coating unit including a second coating impression cylinder;

a third coating unit including a third coating impression cylinder;

a drying unit including a transfer cylinder for transporting the sheet-like material and one or more drying devices opposed to the transfer cylinder for drying the sheet-like material transported by the transfer cylinder; and a fourth coating unit including a fourth coating impression cylinder;

the first printing impression cylinder and the first coating impression cylinder being in contact with one another, the first coating impression cylinder and the second printing impression cylinder being in contact with one another, the second printing impression cylinder and the second coating impression cylinder being in contact with one another, the second and third coating impression cylinders being in contact with one another, the third coating impression cylinder and the transfer cylinder being in contact with one another, the transfer cylinder disposed near the fourth coating impression cylinder, said first and second coating units for applying a first and second coating to a first surface of the sheet-like material, said third and fourth coating units for applying a third and fourth coating to a second surface of the sheet-like material, each of said coating units including a drying device therein, wherein each of said drying devices dries a respective coating applied to the sheet-like material at least to an extent that a subsequent coating or printing impression cylinder is not substantially stained by the respective coating;

wherein the first, second, third and fourth coating units are adapted to coat the sheet-like material with two coatings on each of the first and second surfaces thereof;

wherein the first and second printing units are adapted to print the sheet-like material on the second surface thereof in a single pass through the apparatus;

wherein the coating and printing are performed in a single pass through the apparatus.

7. The apparatus according to claim 6, further comprising:

a delivery unit including a delivery chain for receiving the sheet-like material from the fourth coating impression cylinder, and one or more second surface side drying devices disposed adjacent to the delivery chain, said second surface side drying devices drying the second surface of the sheet-like material.

8. The apparatus according to claim 6, further including a feeding unit;

wherein said first printing unit is connected to the feeding unit which is adapted to feed the sheet-like material to the first printing unit.

9. A method of performing a single pass, perfecting sheet-like material printing and coating operation, comprising:

adjacently arranging a first printing impression cylinder and a first coating impression cylinder such that the first printing impression cylinder contacts the first coating impression cylinder;

adjacently arranging the first coating impression cylinder and a second printing impression cylinder such that the first coating impression cylinder contacts the second printing impression cylinder;

adjacently arranging the second printing impression cylinder and a second coating impression cylinder such that the second printing impression cylinder contacts the second coating impression cylinder;

adjacently arranging the second coating impression cylinder and a third coating impression cylinder such that the second coating impression cylinder contacts the third coating impression cylinder;

adjacently arranging the third coating impression cylinder and a transfer cylinder of a drying unit the drying unit including said transfer cylinder and one or more drying devices located adjacent the transfer cylinder, such that the third coating impression cylinder contacts the transfer cylinder of the drying unit;

disposing the transfer cylinder of the drying unit adjacent a fourth coating impression cylinder, said first and second coating impression cylinders applying a first and second coating to a first surface of the sheet-like material, said third and fourth coating impression cylinders applying a third and fourth coating to a second surface of the sheet-like material, drying a respective coating applied to the sheet-like material at least to an extent that a subsequent coating or printing impression cylinder is not substantially stained by the respective coating;

wherein the first, second, third and fourth coating impression cylinders coat the sheet-like material with two coatings on each of the first and second surfaces thereof;

wherein the first and second printing impression cylinders print the sheet-like material on the first and second surface thereof in a single pass; and wherein the coating and printing operations are performed in a single pass.

10. The method according to claim 9, wherein said one or more drying devices dry the first surface of the sheet-like material and further comprising:

receiving the sheet from the fourth coating impression cylinder with a delivery unit, drying, the second surface of the sheet-like material with a drying device disposed adjacent to the delivery unit.

* * * * *